United States Patent [19]

Miller

[11] 3,987,587

[45] Oct. 26, 1976

[54] COLD AIR DRAFT PREVENTION DEVICE

[76] Inventor: Spencer J. Miller, 1165 Ruberta Ave., Glendale, Calif. 91201

[22] Filed: Sept. 29, 1975

[21] Appl. No.: 617,705

[52] U.S. Cl. ..... 49/493; 49/482; 49/495

[51] Int. Cl.[2] ..... E06B 7/23

[58] Field of Search ..... 49/493, 476, 482, 484, 49/475, 495

[56] References Cited

UNITED STATES PATENTS

| | | | |
|---|---|---|---|
| 1,671,349 | 5/1928 | Crist | 49/493 |
| 1,836,094 | 12/1931 | Toncray | 49/482 |
| 1,877,448 | 9/1932 | Fitzgerald | 49/493 |
| 3,504,456 | 4/1970 | Frederick, Jr. | 49/482 X |

FOREIGN PATENTS OR APPLICATIONS

| | | | |
|---|---|---|---|
| 895,965 | 9/1953 | Germany | 49/495 |

*Primary Examiner*—Philip C. Kannan

[57] ABSTRACT

A door bottom draft prevention device has an elongate mounting strip and a pair of flanges extending along an edge portion of the device and having continuously curved convex external surfaces facing away from the mounting strip. An elongate channel is centrally located between the flanges and has an internal arc greater than 180° and an elongate opening facing away from the mounting strip. Both sides of the channel with its internal arc blend at the elongate opening into the continuously curved convex external surfaces of the flanges. A retaining member having a circular cross-section is located in the channel and retains therein a flexible strip extending about the retaining member and forming a double walled curtain adjacent the channel and the flanges.

4 Claims, 4 Drawing Figures

COLD AIR DRAFT PREVENTION DEVICE

This invention generally relates to cold air draft prevention, and more particularly to a door bottom cold air draft prevention device, to be attached at the bottom of any door to prevent the cold air draft through the generally large openings under door bottoms when a door is in a closed position, yet it allows the door to swing back and forth freely without restriction over uneven rugs or floors without damaging the device or the carpets or rugs, even under extensive repeated use.

It is common knowledge that large quanities of cold air pass under non-weatherstripped door bottoms into heated rooms when doors are closed, because large openings generally exist under doors when door bottoms have been cut off sufficiently to clear the highest obstruction over which the door bottom must pass when swinging in use, and at present most door bottom draft prevention devices are solid or semi solid, and will not glide over uneven floors, also door bottom seals that are constructed to be mechanically raised when opening the door to clear uneven floors are expensive, require maintenance, are difficult to install and sometimes drag heavily over uneven floors or rugs when opening or closing doors.

It is therefore a primary object of my invention to provide a "Door Bottom Draft Prevention Device" designed to be attached on the face of any door at the bottom edge, which can be easily installed and readily adjusted and be capable of long life without maintenance, yet capable of stopping the cold air draft under door bottoms.

Another object of my invention is to provide a "Door Bottom Draft Prevention Device" that will minimize the cold air draft under door bottoms and yet be flexible enough to be readily distorted to conform to uneven surfaces, yet due to its unique design and construction will last for years inasmuch as the plastic curtain will always be flexed over a radius many times greater than its recommended minimum bend radius.

A further objective of my invention is to provide a dead air space between the double curtain seal which will produce additional insulating ability to the door bottom draft prevention device when the door is in a closed position.

Another desirable feature of my invention, due to its design and the type of materials used in its construction there will be no damage or wear to rugs, carpets, bare floors or other objects over which the door bottom draft prevention device glides when the unit is properly installed and adjusted.

These together with other objects and advantages which will become subsequently apparent reside in the details of construction and operation as more fully hereafter described and claimed, reference being had to the accompanying drawing forming a part hereof wherein like numerals refer to like parts throughout, and in which:

Figure 1:
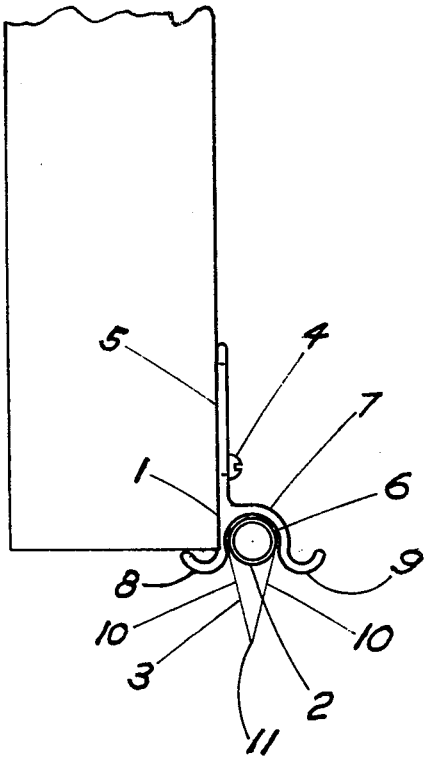
FIG. 1 shows in side elevation a device constructed in accordance with the invention, mounted on a fragmentary section of a door bottom.
Figure 2:
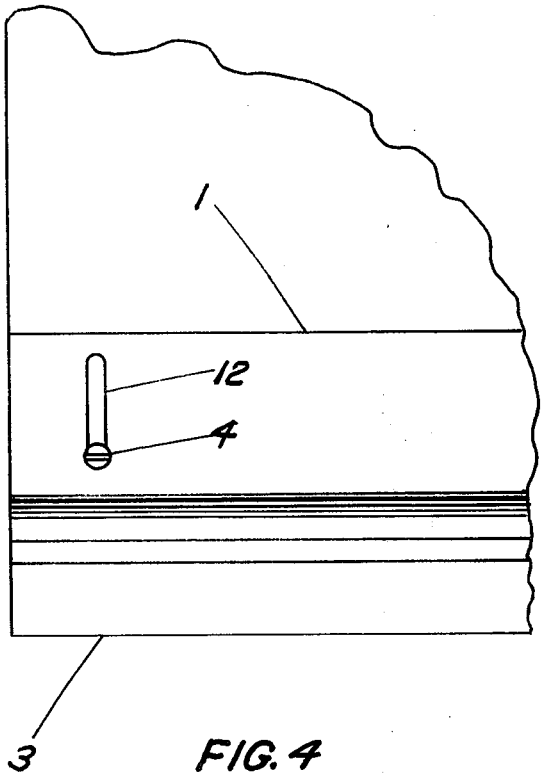
FIG. 2 shows a fragmentary front elevation view of a draft prevention device installed on the face of a door bottom.

In carring out the invention, referring now specifically to the drawing, there is provided a specially formed metal strip 1, with a flat area 5 for mounting said strip, and adjacent to one edge of said flat area 5, but on the opposite side, is positioned a channel 7 with a greater than 180° internal arc 6, into which a soft flexible plastic strip 3 is first wrapped 180° around the thin walled tube or circular cross-section member 2, and then forceably inserted into the greater than 180° internal arc 6 of channel 7, wherein the soft flexible plastic strip 3 is locked permanently in place under compression by a dimensionally coordinated relationship between the greater than 180° internal arc 6, the thin walled tube 2, and the said soft flexible plastic strip 3, said plastic strip 3 then extends equidistantly from the external radii 8 and 9 creating a double walled curtain 10, extending away from the opening of the greater than 180° internal arc channel 7, and extending the entire length of said specially formed metal strip 1.

The soft flexible plastic strip 3 converges together at tip 11, the result of the angle of the arc of the greater than 180° internal arc 6, thus forming an insulating dead air space between the double walled curtain 10.

Figure 3:
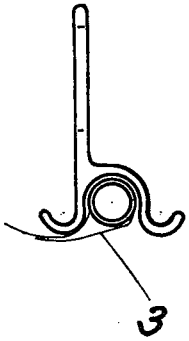
FIG. 3 shows the draft prevention device in side elevation and shows the soft flexible plastic curtain deformed around the large radii provided.
Figure 4:
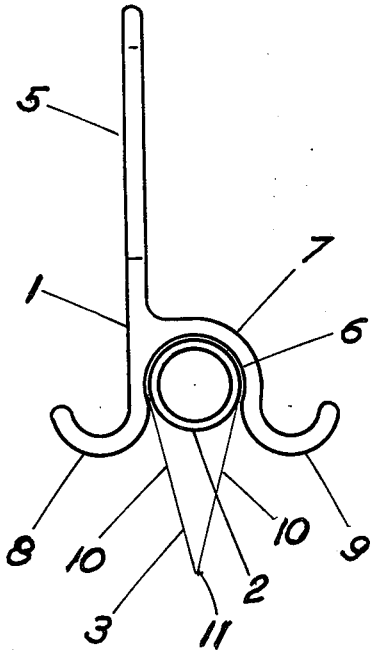
FIG. 4 is an enlarged side elevation view of the device.

The opening at the point where the greater than 180° internal arc 6 blends into the two external radii or continuously curved convex external surfaces formed by a pair of flanges 8 and 9 is smaller than the outside diameter of the soft flexible plastic wrapped thin walled tube 2 thus locking the said plastic wrapped thin walled tube 2 in place and regardless of which way the soft flexible plastic curtain 10 is forced, provides a smooth bending radius or curvature over 2, 8 and 9, that is many times greater than the minimum allowable bend radius of the soft flexible plastic curtain 10. As seen in FIGS. 3 and 4, the arc 6 or channel 7 is centrally located between the flanges 8 and 9.

In the operation of the cold air draft prevention device, the said metal strip 1 is adjusted vertically on the door bottom by means of the slotted mounting holes 12, such that the soft flexible plastic curtain 10 just closes off the gap at the bottom of the door when said door is in a closed position. When the door is swung open over uneven floors the soft flexible plastic curtain 10 is easily deflected and returns to its original curtain shape when the door is closed, due to the fact that the soft flexible plastic curtain 10 has been flexed over a radius many times greater than its minimum recommended bend radius, therefore no internal or external stresses are developed in the plastic curtain.

Although I have shown and described preferred embodiments of my invention, it will be understood that certain portions thereof may be changed to perform the same function and therefore I should not be limited by the specific form described but desire to be afforded the full protection of the following claims.

Having thus completely and fully described the invention what is now claimed as new is as follows:

1. A door bottom draft prevention device comprising in combination an elongate mounting strip, a pair of flanges extending along an edge portion of said device and having continuously curved convex external surfaces facing away from said mounting strip, means providing an elongate channel located centrally between said flanges and having an internal arc greater than 180° and an elongate opening facing away from said mounting strip, both sides of said channel with said internal arc blending at said elongate opening into said continuously curved convex external surfaces of said flanges, a circular cross-section member in said channel, a flexible strip extending about, and being retained in said channel by, said circular cross-section member, and a double walled curtain formed adjacent said channel and flanges by portions of said flexible strip extending from said channel adjacent to each of said flanges.

2. A door bottom draft prevention device as claimed in claim 1, wherein said flexible strip has a minimum allowable bend radius, and each of said convex external surfaces is curved about a radius several times greater than said minimum allowable bend radius.

3. A door bottom draft prevention device as claimed in claim 1, wherein the width of said elongate opening where both sides of said channel with said internal arc blend into said continuously curved convex external surfaces of said flanges is smaller than the outside diameter of said circular cross-section member.

4. A door bottom draft prevention device as claimed in claim 1, wherein said flexible strip has portions converging outside said channel.

* * * * *